US005299509A

United States Patent [19]

Ballard

[11] Patent Number: 5,299,509

[45] Date of Patent: Apr. 5, 1994

[54] CONNECTORS FOR SHELVES AND BINS

[76] Inventor: Donald M. Ballard, 16700 Tinker Pl., Huntersville, N.C. 28078

[21] Appl. No.: 827,408

[22] Filed: Jan. 29, 1992

Related U.S. Application Data

[63] Continuation-in-part of Ser. No. 737,249, Jul. 29, 1991, Pat. No. 5,085,155.

[51] Int. Cl.[5] ..... A47B 3/00

[52] U.S. Cl. ..... 108/182; 100/106

[58] Field of Search ..... 100/111, 110, 106, 107, 100/153; 403/375, 380, 381

[56] References Cited

U.S. PATENT DOCUMENTS

| | | | |
|---|---|---|---|
| 4,149,473 | 4/1979 | Lundqvist | 108/106 X |
| 4,319,792 | 3/1982 | Britt et al. | 108/107 X |
| 4,457,249 | 7/1984 | Disen | 403/300 X |
| 4,711,183 | 12/1987 | Handler et al. | 108/111 |
| 4,800,821 | 1/1989 | Nook et al. | 108/106 X |
| 4,856,746 | 8/1989 | Wrobel et al. | 108/107 X |
| 5,085,155 | 2/1992 | Ballard | 108/111 |

*Primary Examiner*—Jose V. Chen
*Attorney, Agent, or Firm*—Clifton Ted Hurt

[57] ABSTRACT

Improved connectors of the type used for attaching shelves and bins to slot boards are generally shaped like the known W-clips and Z-clips but have ribbed channels to receive one edge portion of a shelf or bin. The edge portions of the shelves and bins are shaped to fit within the channels and grooved to fit around the ribs on the connectors when a connector is attached to a shelf or bin by seating the corresponding edge portion of the shelf or bin in the channel of the connector and seating the rib on the connector in the groove in the shelf or bin to mechanically interlock the connector with its shelf or bin. A combination connector is also provided which can be used either as a W-clip or a Z-clip.

4 Claims, 4 Drawing Sheets

CONNECTORS FOR SHELVES AND BINS

CROSS REFERENCE TO RELATED APPLICATIONS

This application is a continuation-in-part of the applicant's co-pending application Ser. No. 737,249, filed Jul. 29, 1991 for SHELF ASSEMBLY now U.S. Pat. No. 5,085,155.

FIELD OF THE INVENTION

This invention is concerned with shelves and bins supported from a slot board or slot wall for the display of merchandise. The invention is more specifically concerned with the connectors attaching the shelves and bins to the slot board.

BACKGROUND OF THE INVENTION

Slot boards are commonly used for the support of shelves and bins displaying merchandise. Slot boards of the type with which this invention is concerned are typically made of wood with a plurality of vertically spaced horizontally extending slots or grooves. A slot board may be of any desired height and width or may be an entire wall, and the term "slot board" as used hereinafter refers to both slot boards and slot walls unless the context indicates otherwise.

The shelves and bins supported by a slot board are of many shapes and sizes and are typically, but not necessarily, made from a suitable plastic, such as acrylic. The shelves are connected to the slot board by one or more connectors known in the art as W-clips, which are W-shaped profiles. The bins are connected by one or more Z-clips or Z-shaped profiles. One leg of the appropriate W or Z shaped profile is bonded to the shelf or bin and the opposite leg of the profile is inserted in a selected groove in the slot board. The shelf is supported in any desired angular relation to the slot board, while the side of the bin to which the Z-clip is bonded extends at a desired angle to the slot board.

In the illustrated embodiments of the invention, the shelves are flat and the bins are cubical with an open top and four side walls rising from a bottom wall. Only one side of the bin is bonded to the Z-clip.

As known in the art, the shelves and bins are made in many different configurations. The improved connectors of this invention are usable with any shelf or bin that can be supported by a W-clip or Z-clip from a horizontal slot in a slot board.

All of the methods of bonding which have been heretofore used to affix the W-clips and Z-clips have been objectionable because the connection is not reliable, particularly when the shelves and bins are heavily laden. Failure of the clip or its connection results, of course, in the shelf or bin falling from the slot board and the spilling of its contents.

Most of the prior art profiles (W-clips and Z-clips) for connecting the shelves and bins to a slot board are made from plastic. Some of the plastic from which the prior art W-clips and Z-clips have been made is also subject to failure.

An attempt has been made to provide a stronger attachment of the W-clips to the shelves by using a sturdy plastic such as polycarbonate to make the W-clip and by adding a flange to the W-clip to form a channel in which one edge of the shelf is bonded. Another prior embodiment of the W-clip was made from metal with a channel for the shelf and one or more screws were used to hold the shelf in the channel of the metal W-clip. It strengthened the attachment of the W-clip to the shelf, but the cost of time, labor and materials needed to make the attachment with screws is economically unfeasible.

SUMMARY OF THE INVENTION

The weakness of bonding as well as the economic disadvantages of using screws are overcome by the present invention.

According to the invention, the profiled connectors (W-clips and Z-clips) are made from a suitable reinforced plastic or metal and formed with a ribbed channel to receive a correspondingly grooved edge portion of a storage receptable such as a shelf or bin. When assembled for use, the grooved edge portions of the storage receptacles are received in the channels on the connectors and the ribs on the connectors are received in the grooves in the storage receptacle to mechanically interlock the storage receptacles with the connectors. Reliable attachment of the storage receptacles to the improved and strengthened connector clips is thus provided without the cost of labor and materials required in the prior art attachment of clips to the shelves and bins.

DETAILED DESCRIPTION OF THE INVENTION

THE PRIOR ART

Figure 3:
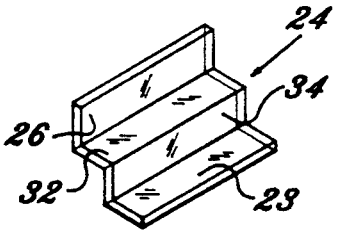
FIG. 3 Prior Art
FIG. 3 is a perspective view of the prior art W-clip or W-shaped profile removed from the slot board and from the shelf.

Referring to FIGS. 1–8, it is known to use a slot board, broadly indicated at 20, to support a shelf 21 and a bin broadly indicated at 22. According to one embodiment of the prior art, one leg 23 of a W-shaped profile or W-clip 24 is attached by bonding 25 (FIG. 7) to the shelf 21 and the opposite leg 26 of the W-clip 23 is inserted in a known manner in a selected slot 27 of the slot board 20.

Figure 2:
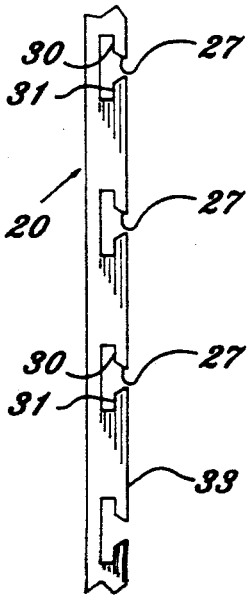
FIG. 2 Prior Art
FIG. 2 is an end view, with parts broken away, of the slot board shown in FIG. 1.

The slot board 20 is preferably made from wood and the plurality of slots 27 extend horizontally between the ends of the board. The board 20 may be of any desired dimensions with vertical spacing of the slots 27. As seen in FIG. 2, each of the slots 27 includes an upper extension 30, and may include a lower extension 31, within the board 20.

Figure 4:
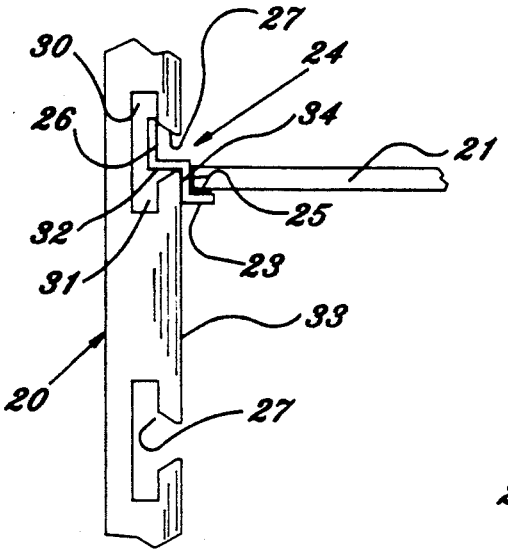
FIG. 4 Prior Art
FIG. 4 is a sectional view taken substantially along the line 4—4 in FIG. 1.

The leg 26 of the prior art W-clip 24 extends vertically in use into the upper extension 30 of a selected slot 27 in the slot board (FIG. 4). A leg 32 of the W-clip extends from the lower end of the leg 26 and outwardly through the slot 27 to the front 33 of the slot board 20. Another leg 34 extends downwardly in FIG. 4 from the leg 32, along the front 33 of the board 20. The leg 23 of the W-clip is shown in FIG. 4 as extending horizontally from the leg 34 but it may extend at any desired angle to the front 33 of the slot board 20. It is the legs 23 and 34 of the prior art W-clip 24 that are attached by bonding 25 to the shelf 21, and it is only the bonding 25 that connects the shelf 21 to the W-clip 24.

Figure 5:
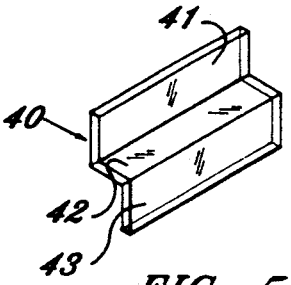
FIG. 5 Prior Art
FIG. 5 is a perspective view of the prior art Z-clip or Z-shaped profile removed from the slot board and from the bin.
Figure 1:
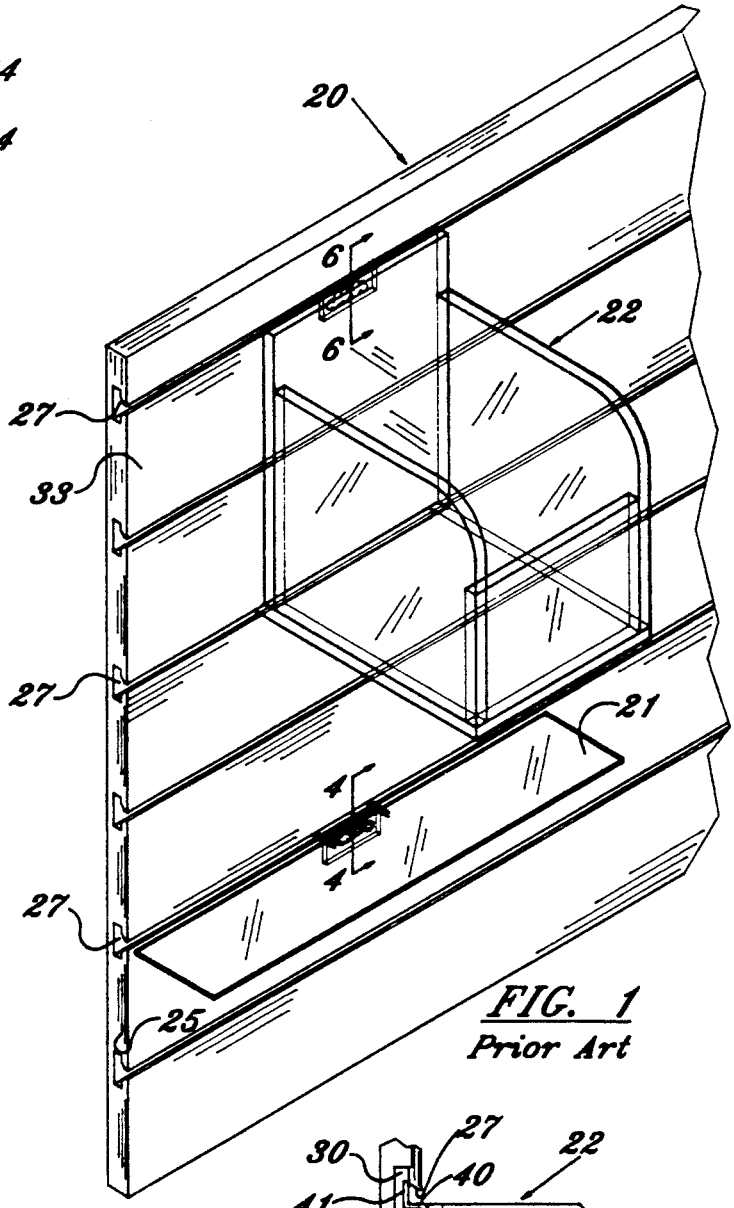
FIG. 1 Prior Art
FIG. 1 is a perspective view illustrating the prior art shelf and bin supported by a slot board.
Figure 6:
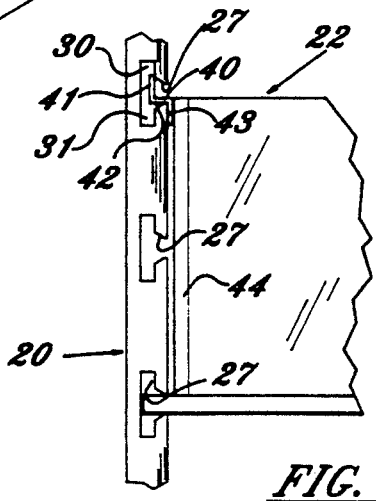
FIG. 6 Prior Art
FIG. 6 is a sectional view taken substantially along the line 6—6 in FIG. 1.

A prior art Z-clip 40, as seen in FIGS. 5 and 6 has only three legs, 41, 42, and 43. The leg 41 corresponds to the leg 26 on the W-clip and extends, in use, into the upper extension 30 of a selected groove 27 in the slot board. The leg 42 of the Z-clip 40 corresponds to the leg 32 of the W-clip 24 and extends from the lower end of the leg 41 and outwardly to the front 33 of the slot board 20. The third leg 43 of the Z-clip 40 corresponds to the leg 34 of the W-clip 24 and extends from the leg 42 of the Z-clip along the front 33 of the slot board 20. It is only the leg 43 of the Z-clip that is attached by bonding 25 to the back wall 44 of the bin 22. It is not unusual for the bond to fail in use, resulting in spillage of the contents of the bin.

Figure 7:
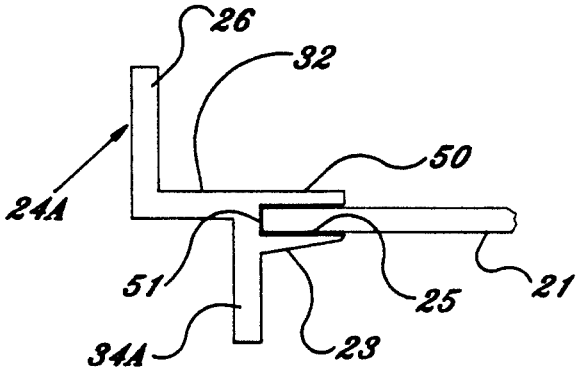
FIG. 7 Prior Art
FIG. 7 is an end view of a prior art W-clip formed from plastic with a channel and showing a shelf, with parts broken away, bonded in the channel of the W-clip.

Prior efforts to overcome the repeated failures of the bonding of the W-clip 24 to the shelf 21 have included making a modified W-clip 24A (FIG. 7) with an extension 50 of the horizontal leg 32 in FIG. 7. The extension 50 extends in spaced parallel relation above the shelf supporting leg 23 to increase bonding area and form a shelf receiving channel 51. The channel and the additional bonding area provide additional strength and is an improvement over the initial W-clip 24, but is unsatisfactory because the bonding still fails.

Figure 8:
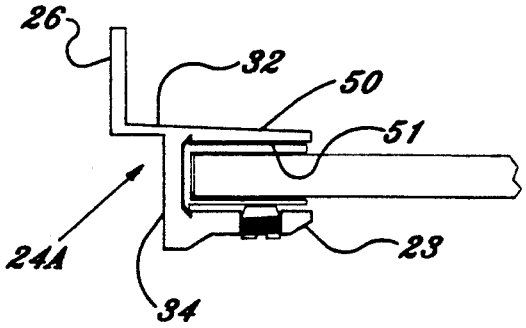
FIG. 8 Prior Art
FIG. 8 is an end view of another prior art W-clip formed from metal with a channel and showing a shelf, with parts broken away, held in the channel of the W-clip by screws.

FIG. 8 illustrates another attempt to strengthen the attachment of the shelf within the channel 51 of modified W-clip 24A. Here, the W-clip 24A is extruded from aluminum and the bonding is replaced with one or more screws 52 extending through the leg 23 and against the shelf 21 to bind the shelf between the leg 50 and the leg 23 in FIG. 8. Additional strength is provided but the use of screws is not cost effective because of the cost of the screws and the expense of time and labor to install them.

THE INVENTION

One profiled connector 60 (FIG. 10) of this invention is an improvement of the modified W-clip 24A (FIGS. 7 and 8). A second profiled connector 80 (FIG. 13) of this invention is an improvement of the prior art Z clip 40 (FIG. 5), and a third profiled connector 100 (FIG. 14) of this invention is a combination of the improved W-clip 60 and the improved Z-clip 80.

All three of the improved connectors have the advantage of providing a reliably storing connection of a compatible shelf or bin (storage receptacle) to its connector without failure of the prior art bonding materials or the necessity in the prior art of using additional materials to attach the prior art clips to the shelf or bin.

The Improved W-Clip

Figure 9:
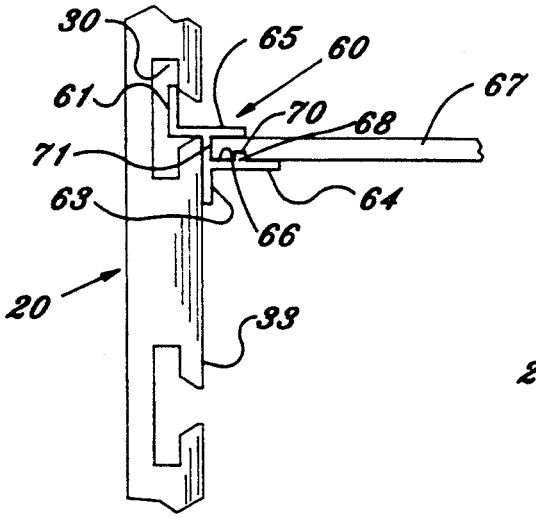
FIG. 9 is an end view of a portion of the slot board shown in FIGS. 1 and 2 supporting an improved W-clip with a ribbed channel in interlocking engagement with a grooved shelf, according to the present invention.

The improved W-clip 60 (FIGS. 9, 10, and 11) is made from a suitably sturdy reinforced plastic or sturdy metal in the general configuration of the modified W-clip 24A (FIG. 7). The improved W-clip 60 has five legs, 61, 62, 63, 64, and 65, corresponding to legs 26, 32, 34A, 23, and 50 of the modified prior art W-clip 24A. The leg 63 of the improved W-clip 60 extends below the load supporting leg 64 to increase the bearing surface against the slot board 20, as does the leg 34A on the modified W-clip 24A.

The extension 65 of leg 62 on the improved W-clip 60 lies in spaced parallel relation to the shelf supporting leg 64 to form a channel 66 which receives one edge of a shelf 67. The load supporting leg 64 extends beyond the leg 65 to provide additional support for the shelf 67.

Figure 10:
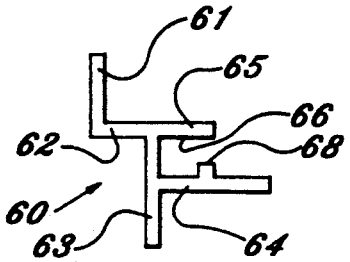
FIG. 10 is an end view of the improved W-clip with a ribbed channel removed from the slot board and from the grooved shelf.
Figure 11:
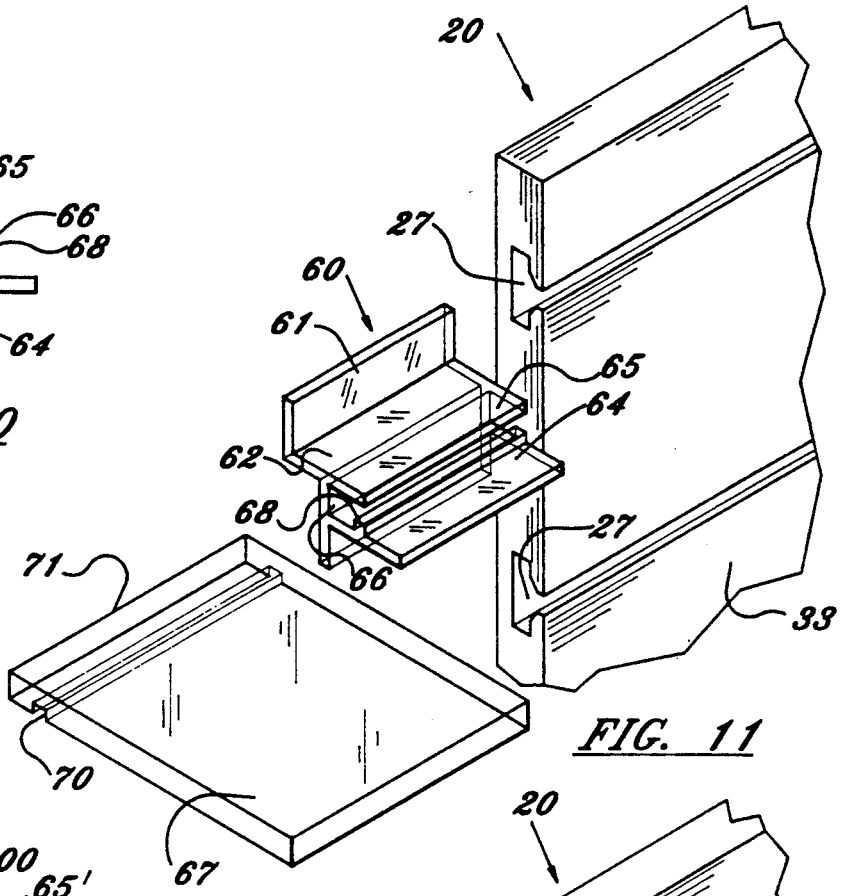
FIG. 11 is an exploded perspective view of the slot board, W-clip with a ribbed channel, and grooved shelf shown in FIG. 9.

A rib 68 on load supporting leg 64 is spaced outwardly from vertical leg 63 and extends upwardly toward the free end of leg 65 on the improved W-clip 60 in FIG. 10. The shelf 67 has a groove 70 in its lower surface in FIGS. 9 and 11 that is spaced inwardly from one longitudinal edge 71 of the shelf 67. The groove 70 registers with the rib 68 on the W-clip 60 when the clip 60 and shelf 67 are assembled for use. The two are easily assembled by simply positioning the rib 68 in the groove 70 and sliding the clip to a desired location along the edge 71 of the shelf 67. The W-clip 60 and the shelf 67 are then mechanically interlocked and the installation of the shelf is completed by positioning in the usual manner the leg 61 of the W-clip 60 in a selected slot 27 in the slot board 20.

The Improved Z-Clip

Figure 13:
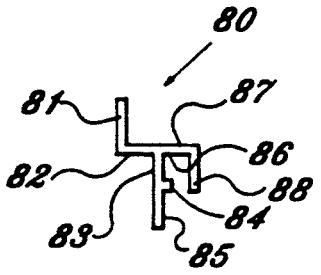
FIG. 13 is an end view of the improved Z-clip with a ribbed channel removed from the slot board and from the bin.

The improved Z-clip 80 (FIGS. 12 and 13) has legs 81, 82, and 83 corresponding to the legs 41, 42 and 43 on the prior art Z-clip 40 (FIG. 5). As seen in FIG. 13, the load supporting leg 83 has an extension 85 that makes it longer than the corresponding leg 43 on the prior art Z-clip. The extension 85 increases the bearing surface against the slot board 20 and provides space for a rib 84.

A channel 86 is formed on the Z-clip 80 by the inner portion of leg 83, an extension 87 of the leg 82, and a leg 88 extending downwardly in FIG. 13 from leg 87 in spaced parallel relation to the leg 83. The bottom of the channel 86 in FIG. 13 is open to receive the upper edge portion of one wall of a bin 90, as in FIG. 12. The rib 84 is directed toward the free end of leg 88 at the open end of channel 86.

Figure 12:
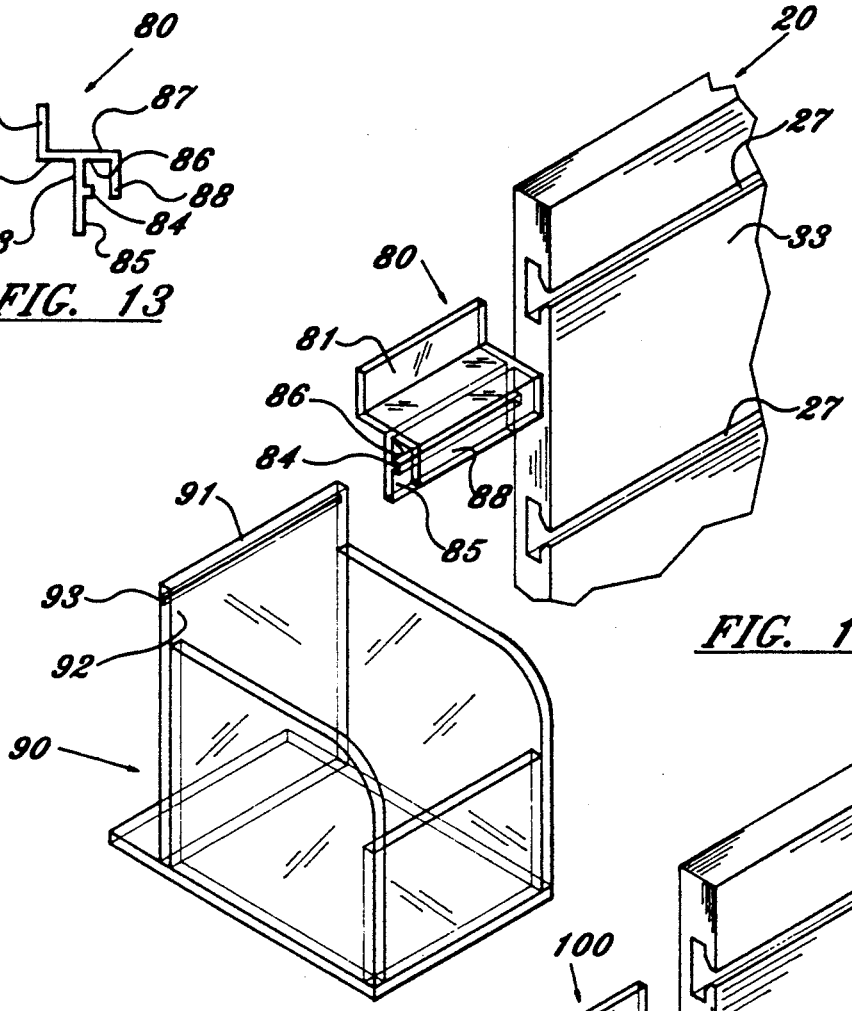
FIG. 12 is an exploded perspective view of the slot board shown in FIGS. 1 and 2 supporting an improved Z-clip with a ribbed channel in interlocking engagement with a grooved wall of a bin, according to the present invention.

The improved Z-clip 80 is connected to the bin 90 by placing the upper edge 91 of the bin's rear wall 92 in the channel 86 in the Z-clip 80, as shown in FIG. 12, and sliding the Z-clip along the upper edge 91 to a desired location on the bin 90. The rear wall 92 of the bin has a groove 93 spaced from the upper edge 91 to register with the rib 84 when the Z-clip 80 and bin 90 are assembled as shown in FIG. 12. The Z-clip 80 and bin 90 are then mechanically interlocked. The leg 81 of Z-clip 80 is positioned in the usual manner in a selected slot 27 on the slot board 20 to support the bin.

The load bearing capacities of the bin 90 and shelf 67, using their sturdy interlocking connectors, is not limited by bond strength or the tightness of the screws used in the prior art.

The Combination Clip

Figure 14:
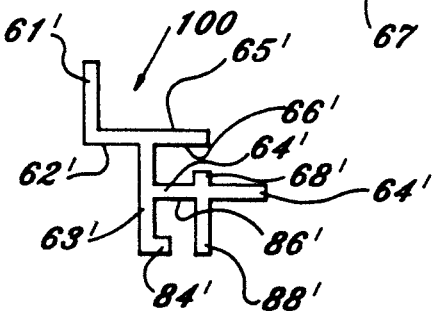
FIG. 14 is an end view of a combination W and Z-clip with a ribbed channel for the grooved shelf and with a ribbed channel for the grooved bin.
Figure 15:
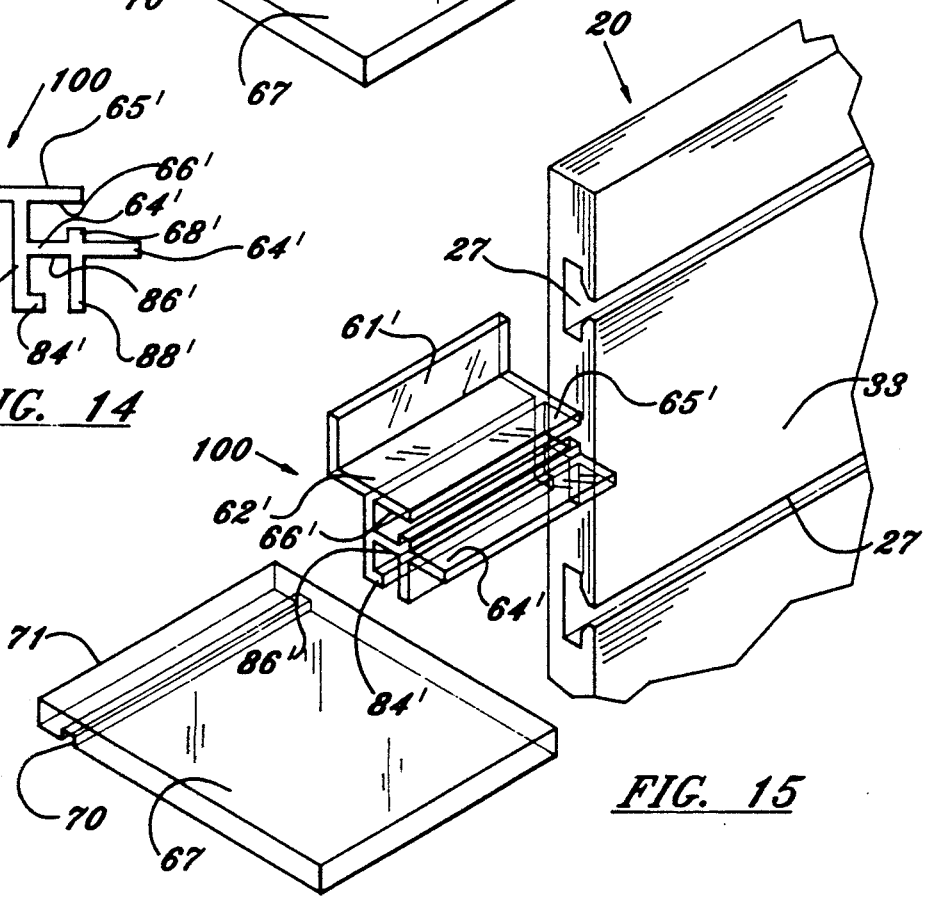
FIG. 15 is an exploded perspective view similar to FIG. 11 but showing the combination W and Z-clip of FIG. 14 connecting the grooved shelf to the slot board.
Figure 16:
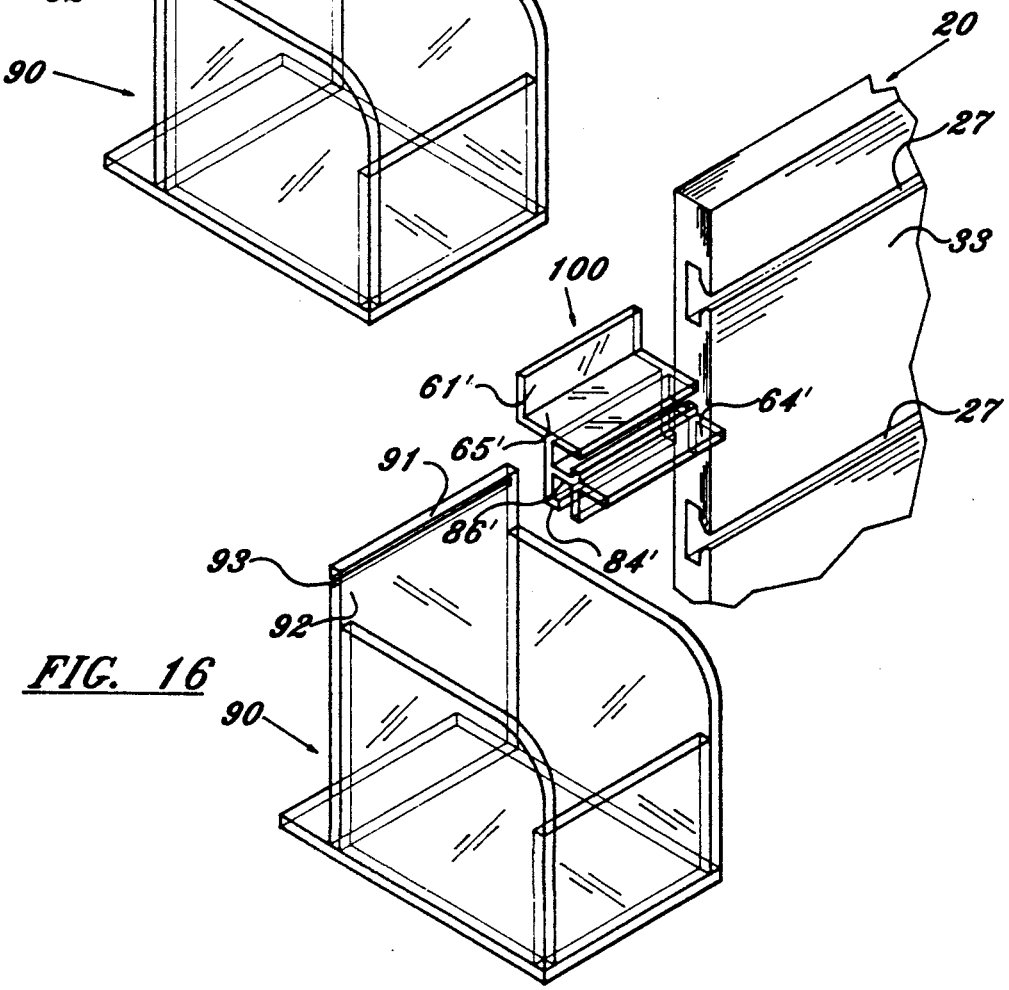
FIG. 16 is an exploded perspective view similar to FIG. 12 but showing the combination W and Z-clip of FIG. 14 connecting the grooved bin to the slot board.

A combination clip 100 (FIG. 14) combines the configuration of the improved W-clip 60 (FIG. 10) with the configuration of the improved Z-clip 80 (FIG. 13) and is usable to connect either the grooved shelf 67, as shown in FIG. 15, or the bin 90 with its grooved rear wall 92 as shown in FIG. 16.

Comparing FIGS. 10 and 14, it will be seen that the elements of the combination clip in FIG. 14 have been marked with the same reference numbers as like elements on the improved W-clip in FIG. 10, with the prime notation added to the reference numbers of like parts in FIG. 14, such as load supporting leg 64'.

Similarly, the elements of the combination clip 100 in FIG. 14 have been marked with the same reference numbers as like elements on the improved Z-clip in FIG. 13, with the prime notation added to the reference numbers of like parts in FIG. 14, such as load supporting leg 83'.

The channel $66^1$ on the combination clip 100 in FIG. 15 receives the edge 71 of grooved shelf 67 in the same manner as channel 66 on the improved W-clip 60 (FIG. 11) has been described as receiving the edge 71 of grooved shelf 67. The shelf and clip are interlocked in both cases by positioning the grooved edge portion of the shelf in the channel on the clip and by seating the rib in the groove in the shelf. The channel $86^1$ is not used when it is desired to use the combination clip 100 to connect a shelf to the slot board.

Similarly, the channel $66^1$ is not used when it is desired to use the combination clip 100 to connect a bin to the slot board. As shown in FIG. 16, the channel $86^1$ receives the upper edge 91 of bin 90 and the rib $84^1$ is seated in the groove $93^1$ to interlock the combination clip 100 with the bin.

There is thus provided improved connectors for supporting shelves and bins from slot boards. The improved W-clips and Z-clips have the advantages of increased strength and of economies in time and materials.

Although specific terms have been employed in describing the invention, they have been used in a generic and descriptive sense only and not for the purpose of limitation.

I claim:

1. In combination with a slot board and a storage receptacle; a connector for supporting the storage receptacle from a selected slot in the slot board, said connector comprising:

(a) a first leg extending vertically in use and engaging a first portion of the slot board adjoining the selected slot, (b) a second leg extending horizontally in use from the first leg and engaging a second portion of the slot board adjoining the selected slot, (c) an axial extension of the second leg extending away from the slot board, (d) a load supporting leg, (e) a rib extending longitudinally along the load supporting leg, (f) means connecting the load supporting leg to the second leg for support by the slot board, (g) the load supporting leg and the axial extension of the second leg defining two sides of a channel in the connector, (h) the storage receptacle including a portion that fits within the channel in the connector, and (i) said portion of the storage receptacle having a groove within which the rib on the load supporting leg fits when the storage receptacle is operatively received in said channel.

2. The invention of claim 1 wherein the storage receptacle is a shelf and the channel in the connector is oriented to support the shelf.

3. The invention of claim 1 wherein the storage receptacle is a bin and the channel in the connector is oriented to support the bin.

4. The invention of claim 3 wherein the channel in the connector that is oriented to support a bin is a first channel, and the connector includes a second channel, said second channel being oriented to support a shelf, whereby the connector may be used to selectively attach either a bin or a shelf to a selected slot in the slot board.

* * * * *